US007553209B1

(12) United States Patent
Sorensen

(10) Patent No.: US 7,553,209 B1
(45) Date of Patent: Jun. 30, 2009

(54) TOY-BUILDING ELEMENTS FOR VARIABLY POSITIONAL TOYS

(76) Inventor: Soren Christian Sorensen, 13404 Kibbings Road, San Diego, CA (US) 92130

( * ) Notice: Subject to any disclaimer, the term of this patent is extended or adjusted under 35 U.S.C. 154(b) by 201 days.

(21) Appl. No.: 11/131,830

(22) Filed: May 17, 2005

(51) Int. Cl.
*A63H 33/06* (2006.01)
*A63H 33/08* (2006.01)

(52) U.S. Cl. ..... 446/124; 446/85; 446/127; 446/128

(58) Field of Classification Search ..... 446/117, 446/124, 125, 120, 121, 128, 85, 127; 52/590.1, 52/590.5, 590.6, 590.3
See application file for complete search history.

(56) References Cited

U.S. PATENT DOCUMENTS

| | | | | |
|---|---|---|---|---|
| 171,533 | A | 12/1875 | Schmetzer | |
| 2,106,148 | A | 1/1938 | Kellner | |
| 2,972,833 | A | 2/1961 | La Grutta | |
| 3,224,137 | A | 12/1965 | Wright et al. | |
| 3,469,339 | A | 9/1969 | Thomas | |
| 4,170,083 | A | 10/1979 | Freelander et al. | |
| 4,226,045 | A * | 10/1980 | Lehmann et al. | 446/101 |
| 4,306,373 | A | 12/1981 | Chatani et al. | |
| 4,430,826 | A | 2/1984 | Ryaa | |
| 4,458,441 | A | 7/1984 | Bril | |
| 4,624,647 | A | 11/1986 | Munnix | |
| 4,642,064 | A | 2/1987 | Yoke | |
| 4,764,144 | A | 8/1988 | Lyman | |
| 5,019,010 | A * | 5/1991 | Nikaido et al. | 446/487 |
| 5,022,885 | A | 6/1991 | Lyman | |
| 5,069,647 | A | 12/1991 | Zuviria | |
| 5,259,803 | A | 11/1993 | Lyman | |
| 5,312,283 | A | 5/1994 | Lyman | |
| 5,645,463 | A | 7/1997 | Olsen | |
| 5,769,681 | A | 6/1998 | Greenwood, Sr. et al. | |
| 5,853,314 | A | 12/1998 | Bora | |
| D410,708 | S | 6/1999 | Toft | |
| 5,913,706 | A | 6/1999 | Glickman et al. | |
| D412,946 | S | 8/1999 | Pagel | |
| D413,942 | S | 9/1999 | Rudy | |
| D415,217 | S | 10/1999 | Rudy | |
| 6,250,986 | B1 | 6/2001 | Sorensen | |
| 6,447,360 | B1 * | 9/2002 | Sorensen | 446/124 |
| 6,616,499 | B1 | 9/2003 | Sorensen | |
| 6,736,691 | B1 * | 5/2004 | Bach | 446/128 |

* cited by examiner

*Primary Examiner*—Nini Legesse
(74) *Attorney, Agent, or Firm*—Edward W. Callan

(57) ABSTRACT

Toy-building elements including various combinations of the following features: a top having a broad surface and at least one projection or ball-shaped coupler extending above the broad surface; an interior having contact surfaces that are accessible through an open bottom and are adapted for effecting a releasable restraining engagement with an interconnectable projection or ball-shaped coupler on a second toy-building element; at least one sidewall including at least one groove for effecting a releasable restraining engagement with a tongue in a sidewall of another toy-building element; at least one sidewall including at least one tongue for effecting a releasable restraining engagement within a groove in a sidewall of still another toy-building element; and at least one sidewall including an axel-shaped or ball-shaped coupler for effecting a variably positional engagement with an interconnectable coupler in yet another toy-building element. These toy-building elements are combined with others to assemble person-like and vehicle-like toy figures.

18 Claims, 6 Drawing Sheets

FIG. 11A
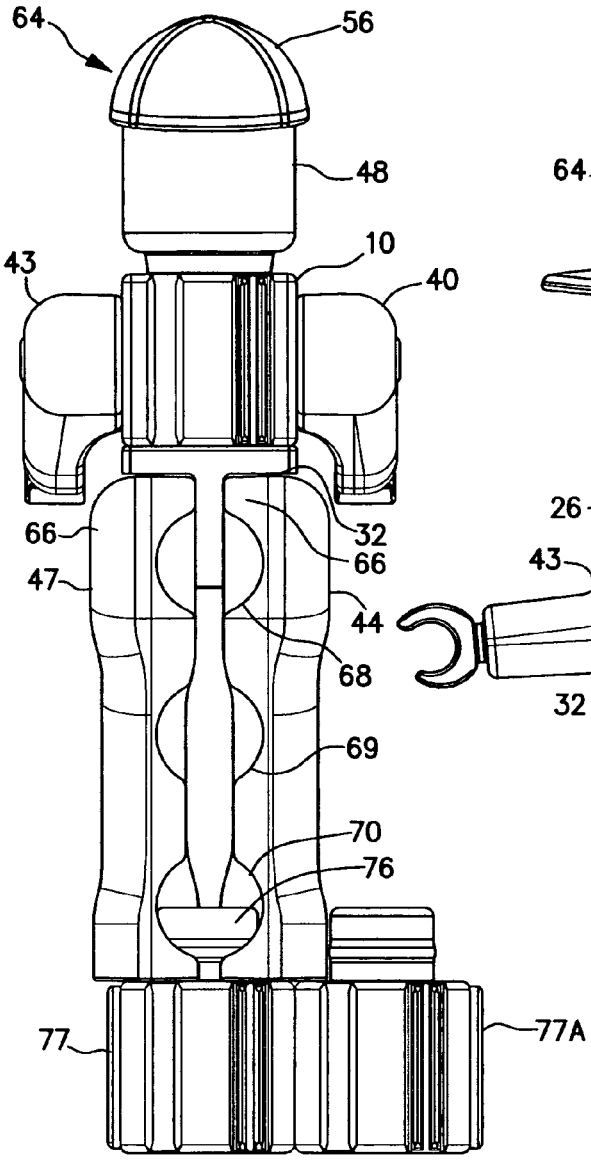
FIG. 12
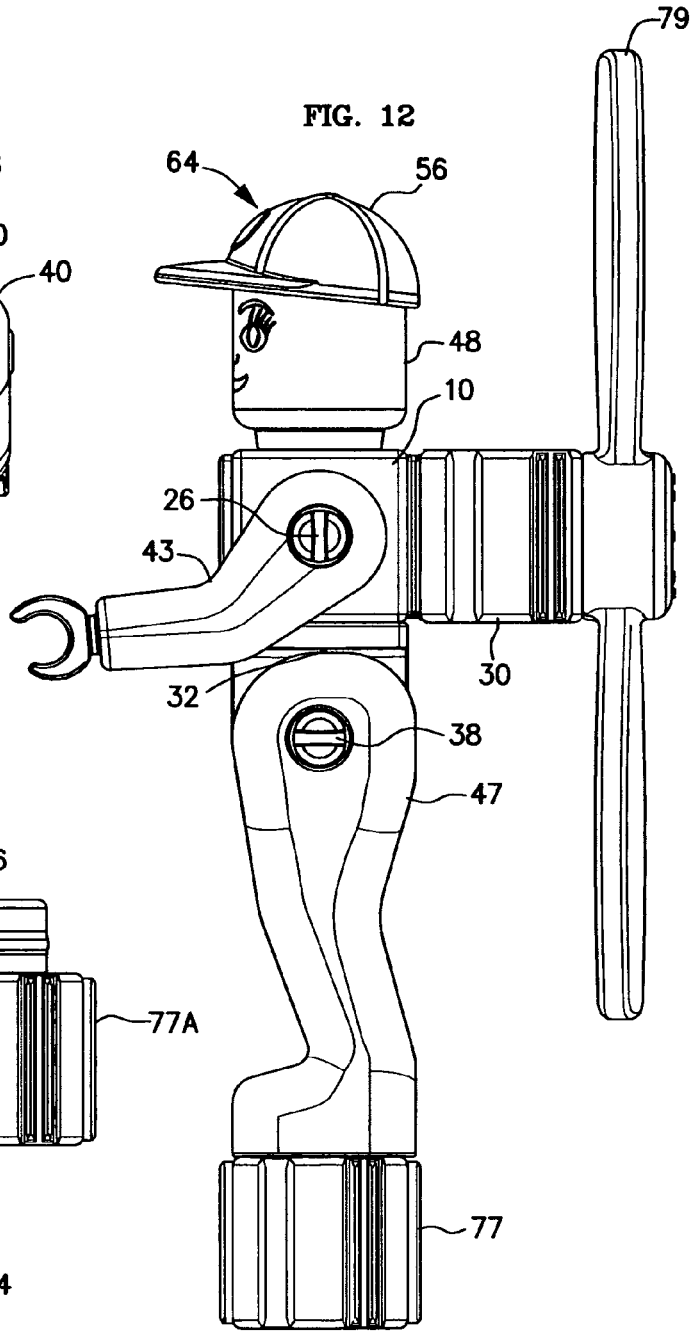
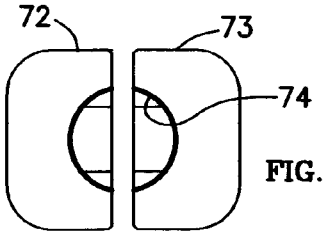
FIG. 11B
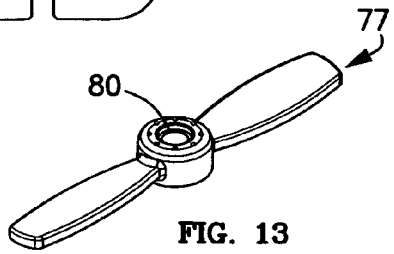
FIG. 13
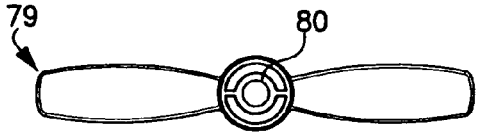
FIG. 13A

TOY-BUILDING ELEMENTS FOR VARIABLY POSITIONAL TOYS

BACKGROUND OF THE INVENTION

The present invention generally pertains to toy-building elements and is particularly directed to toy-building elements for use in assembling variably positional toys, in which one or more elements of the toy is variably positional in relation to another element of the toy.

SUMMARY OF THE INVENTION

The present invention provides a combination of toy-building elements for a toy that includes a plurality of toy-building elements, the combination including a first toy-building element comprising: sidewalls; a top having a broad surface that extends toward the sidewalls and at least one projection extending above the broad surface; an open bottom; and an interior having contact surfaces that are accessible through the open bottom and are for effecting a releasable restraining engagement with an interconnectable projection on a second toy-building element; wherein at least one of the sidewalls includes a coupler for effecting a variably positional engagement with an interconnectable coupler in another toy-building element that can be variably positioned in relation to the first toy-building element when the coupler of the first toy-building element is engaged with said interconnectable coupler of said another toy-building element; and a second toy building element, comprising: a body; and a late a projection that extends from the top of the plate for effecting said engagement with the interior contact surfaces of the first toy-building element; a member that extends from the bottom of the plate; and a pair of couplers that extend from opposite sides of the member for respectively effecting a variably positional engagement with an interconnectable coupler in a further toy-building element that can be variably positioned in relation to the second toy-building element when a said coupler of the second toy-building element is engaged with said interconnectable coupler of said further toy-building element; wherein the lateral breadth of the member in at least the dimension in which the couplers extend is less than the lateral extension of the plate.

Additional features of the present invention are described with reference to the detailed description of the preferred embodiments.

BRIEF DESCRIPTION OF THE DRAWING

FIG. 3A is a bottom perspective view of the toy-building element of FIG. 3.

FIG. 11A is a back view of the person-like toy figure of FIG. 11.

FIG. 11B is a bottom view of the feet of the person-like toy figure of FIG. 11.

FIG. 12 is a perspective view of another embodiment of a person-like toy figure constructed by combining some of the toy-building elements of the present invention.

FIG. 13 is a front perspective view of an embodiment of a propeller-shaped toy-building element that is utilized in a combination of toy-building elements according to the present invention.

FIG. 13A is a back view of the propeller-shaped toy-building element of FIG. 13.

DETAILED DESCRIPTION

Figure 1:
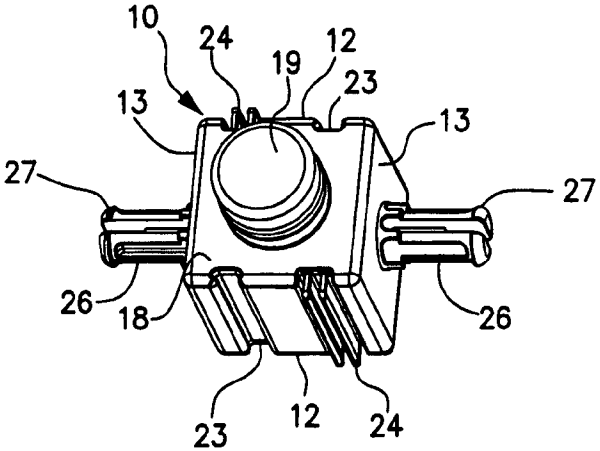
FIG. 1 is a top perspective view of one embodiment of one toy-building element according to the present invention.
Figure 1A:
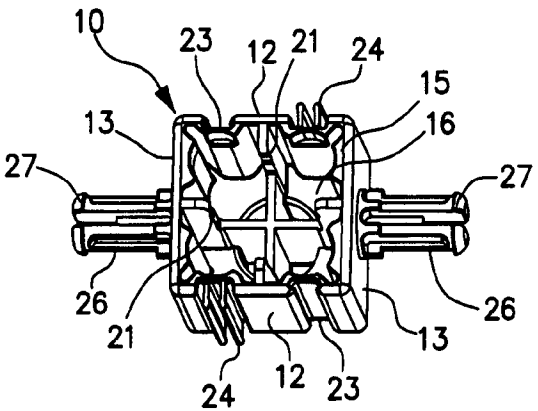
FIG. 1A is a bottom perspective view of the toy-building element of FIG. 1.

Referring to FIGS. 1 and 1A, one embodiment of a toy-building element 10 according to the present invention includes sidewalls 12, 13, a top, an open bottom 15 and an interior 16. The top has a broad surface 18 that extends toward the sidewalls 12, 13 and a projection 19 extending above the broad surface 18. In alternative embodiments (not shown) more than one projection extends above the top broad surface.

The interior 16 has contact surfaces 21 that are accessible through the open bottom 15 and are adapted for effecting a releasable restraining engagement with an interconnectable projection on a second toy-building element. In alternative embodiments (not shown) the interior contact surfaces are adapted for effecting releasable restraining engagements with a plurality of interconnectable projections on another toy-building element or on a combination of other toy building elements.

In the preferred embodiments, the projection 19 and the interior contact surfaces are configured as described in U.S. Pat. No. 6,447,360 to Soren Christian Sorensen, the disclosure of which is incorporated by reference. Other configurations may be used in other embodiments.

Each of two oppositely disposed sidewalls 12 includes at least one groove 23 and at least one tongue 24. Each groove 23 is adapted for effecting a releasable restraining engagement with a tongue in a sidewall of another toy-building element; and each tongue 24 is adapted for effecting a releasable restraining engagement with a groove in a sidewall of another toy-building element. In the preferred embodiments, the grooves 23 and the tongues 24 are configured as described in U.S. Pat. Nos. 6,250,986 and 6,616,499 to Soren Christian Sorensen, the disclosures of which are incorporated by reference. Other configurations may be used in other embodiments.

Each of the two oppositely disposed sidewalls 13 that do not include either a groove or a tongue includes an axel-shaped coupler 26 for effecting a variably positional engagement with an interconnectable coupler in another toy-building element, that can be variably positioned in relation to the toy-building element 10 when the axel-shaped coupler 26 of the toy-building element 10 is engaged with the interconnectable coupler of the other toy-building element. Examples of toy-building elements that include couplers that are interconnectable with the axel-shaped coupler 26 are shown in FIGS. 4, 5, 13 and 14.

In the preferred embodiment, each axel-shaped coupler 26 includes a distal portion 27 having an uncompressed thickness that is larger than an entry opening of the interconnectable coupler of the other toy-building element. The distal portion 27 of the axel-shaped coupler 26 is split longitudinally so that the thickness of the distal portion 27 can be compressed enough to enable insertion of the distal portion 27 through the entry opening of the interconnectable coupler of the other toy-building element. In other embodiments, the axel-shaped couplers 26 do not necessarily have a split distal portion.

Figure 2:
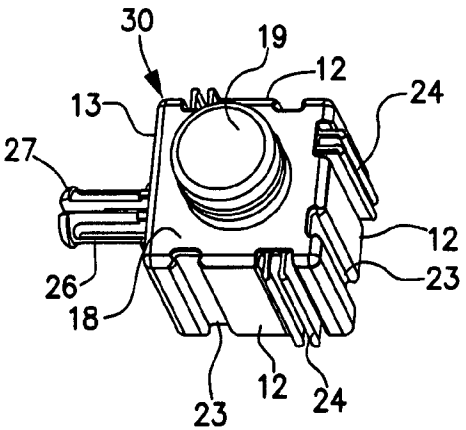
FIG. 2 is a top perspective view of an alternative embodiment of the one toy-building element according to the present invention.
Figure 2A:
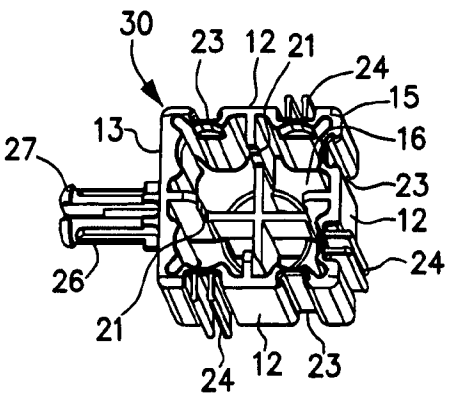
FIG. 2A is a bottom perspective view of the toy-building element of FIG. 2.

FIGS. 2 and 2A show an alternative embodiment 30 of the type of toy-building element shown in FIG. 1. The toy-building element 30 is different than the toy-building element 10 of FIG. 1 in only the following respects. In the toy-building element 30 only one of the sidewalls 13 includes an axel-shaped coupler 26; and the other three sidewalls 12 each includes a groove 23 and a tongue 24.

Figure 3:
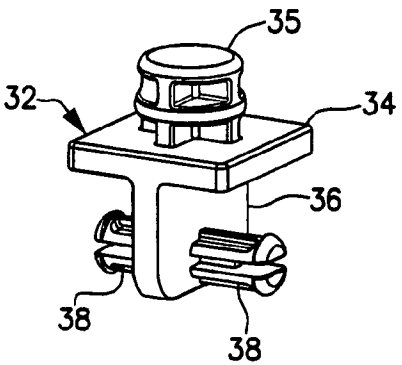
FIG. 3 is a top perspective view of an embodiment of another toy-building element according to the present invention.

Referring to FIG. 3, a preferred embodiment of another type of toy-building element 32 according to the present invention includes a plate 34, a projection 35 that extends from the top of the plate 34 and a member 36 that extends from the bottom of the plate 34.

The projection 35 is adapted for effecting a releasable restraining engagement with the interior contact surfaces 21 of either of the toy-building elements 10 and 12 shown in FIGS. 1 and 2. In the preferred embodiment, the projection 35 is configured as described in the aforementioned U.S. Pat. No. 6,447,360. Other configurations may be used in other embodiments.

In the preferred embodiment, the plate 34 is coextensive with the bottom side 15 of each of the toy-building elements 10, 30 shown in FIGS. 1 and 2 and thereby encloses the open bottom 15 when the projection 35 is engaged with the interior contact surfaces 21. In other embodiments, the plate is not necessarily coextensive with the bottom side 15 of the respective toy-building element 10, 30.

The member 36 that extends from the bottom of the plate 34 includes a pair of axel-shaped couplers 38, which extend from opposite sides of the member 36. Each coupler 38 is adapted for effecting a variably positional engagement with an interconnectable coupler in another toy-building element that can be variably positioned in relation to the toy-building element 32 when the axel-shaped coupler 38 of the toy-building element 30 is engaged with the interconnectable coupler of the other toy-building element. In the preferred embodiment, the axel-shaped couplers 38 are of the same configuration as the axel-shaped couplers 26 of the toy-buildings elements 10, 20 of FIGS. 1 and 2. In other embodiments, the axel-shaped couplers 38 have a different configuration and/or size than the axel-shaped couplers 26 and/or do not necessarily have a split distal portion.

Figure 4:
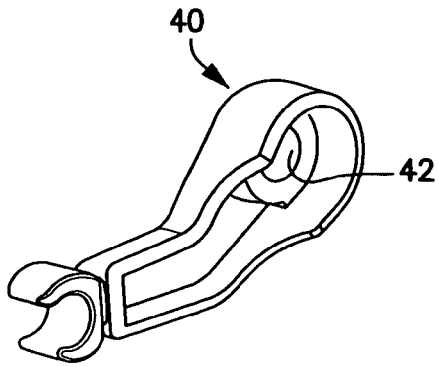
FIG. 4 is an inside perspective view of an embodiment of an arm-shaped toy-building element that is utilized in a combination of toy-building elements according to the present invention.
Figure 4A:
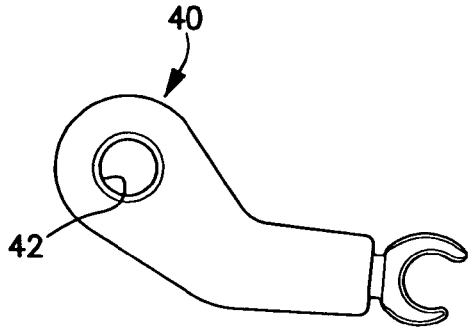
FIG. 4A is an outside view of the arm-shaped toy-building element of FIG. 4.

FIGS. 4 and 4A show a right-arm-shaped toy-building element 40, which includes an opening 42 that is interconnectable with the axel-shaped couplers 26, 38 of the toy-building elements 10, 30, 32 of FIGS. 1, 2 and 3. The opening 42 is adapted for effecting a variably positional engagement with a respective axel-shaped coupler 26, 38. A left-arm-shaped toy-building element 43 (shown in FIGS. 11, 11A and 12) is a mirror image of the right-arm-shaped toy-building element 40.

Figure 5:
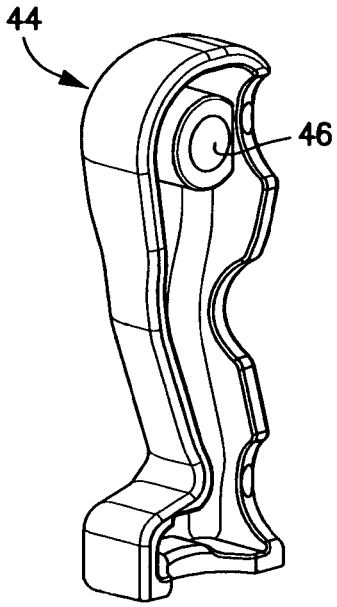
FIG. 5 is an inside perspective view of an embodiment of a leg-shaped toy-building element that is utilized in a combination of toy-building elements according to the present invention.
Figure 5A:
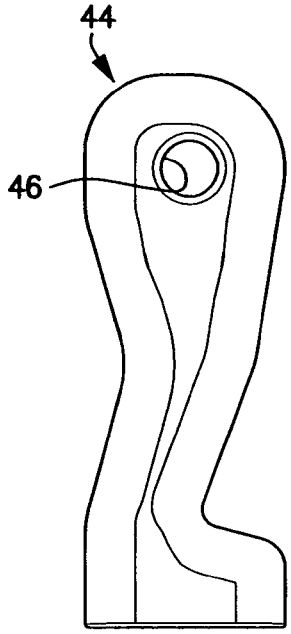
FIG. 5A is an outside view of the leg-shaped toy-building element of FIG. 5.

FIGS. 5 and 5A show a right-leg-shaped toy-building element 44, which includes an opening 46 that is interconnectable with the axel-shaped couplers 26, 38 of the toy-building elements 10, 30, 32 of FIGS. 1, 2 and 3. The opening 46 is adapted for effecting said variably positional engagement with a respective axel-shaped coupler 26, 38. A left-leg-shaped toy-building element 47 (shown in FIGS. 11, 11A and 12) is a mirror image of the right-leg-shaped toy-building element 44.

Figure 6:
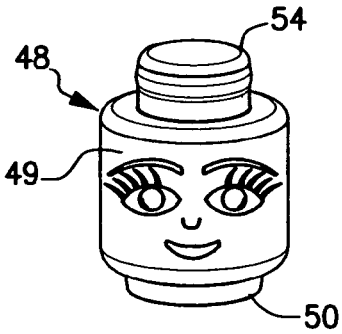
FIG. 6 is a perspective view of an embodiment of a head-shaped toy-building element that is utilized in a combination of toy-building elements according to the present invention.
Figure 6A:
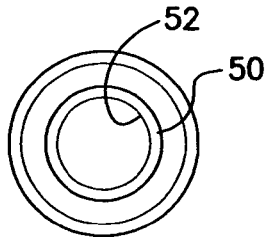
FIG. 6A is a bottom view of the head-shaped toy-building element of FIG. 6.

FIGS. 6 and 6A show a head-shaped toy-building element 48 having a face-like image 49. The head-shaped toy-building element 48 includes an open bottom 50 and an interior having contact surfaces 52 that are accessible through the open bottom 50. The interior contact surface 52 are adapted for effecting a releasable restraining engagement with the projection 19 extending from the top 14 of the toy-building element 10, 30 shown in FIGS. 1 and 2. In the preferred embodiment, the interior contact surfaces 52 are configured as described in the aforementioned U.S. Pat. No. 6,447,360. Other configurations may be used in other embodiments.

The top of the head-shaped toy-building element 48 includes a projection 54 that is adapted for effecting a releasable restraining engagement with the interior contact surfaces of a headwear-shaped toy-building element, such as shown in FIGS. 7, 8, 9 and 10. In the preferred embodiment, the projection 54 is configured as described in the aforementioned U.S. Pat. No. 6,447,360. Other configurations may be used in other embodiments.

Figure 7:
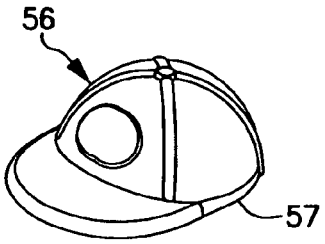
FIG. 7 is a perspective view of an embodiment of a cap-shaped toy-building element that is utilized in a combination of toy-building elements according to the present invention.
Figure 7A:
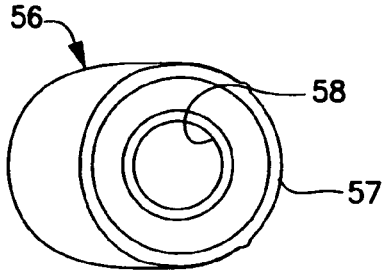
FIG. 7A is a bottom view of the cap-shaped toy-building element of FIG. 7.

FIGS. 7 and 7A show a cap-shaped toy-building element 56. The cap-shaped toy-building element 56 includes an open bottom 57 and an interior having contact surfaces 58 that are accessible through the open bottom 57. The interior contact surface 58 are adapted for effecting a releasable restraining engagement with the projection 54 extending from the top of the head-shaped toy-building element 48 shown in FIG. 6. In the preferred embodiment, the interior contact surfaces 58 are configured as described in the aforementioned U.S. Pat. No. 6,447,360. Other configurations may be used in other embodiments.

Figure 8:
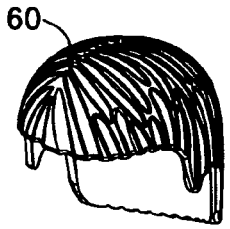
FIG. 8 is a perspective view of one embodiment of a hairpiece-shaped toy-building element that is utilized in a combination of toy-building elements according to the present invention.
Figure 9:
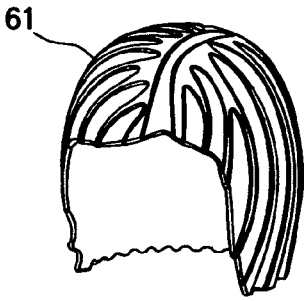
FIG. 9 is a perspective view of another embodiment of a hairpiece-shaped toy-building element that is utilized in a combination of toy-building elements according to the present invention.

FIGS. 8 and 9 respectively show two hair-shaped toy-building elements 60, 61 having different hair styles.

Figure 10:
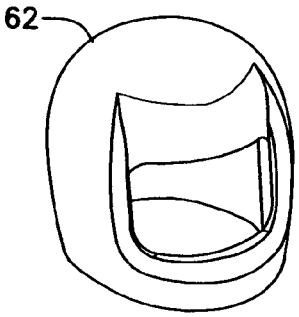
FIG. 10 is a perspective view of an embodiment of a helmet-shaped toy-building element that is utilized in a combination of toy-building elements according to the present invention.

FIG. 10 shows a helmet-shaped toy-building element 62.

Each of the headwear-shaped toy-building elements 60, 61, 62 of FIGS. 8, 9 and 10 have interior contact surfaces (not shown) that are the same as the interior contact surfaces 58 of the cap-shaped toy-building element 56.

Figure 11:
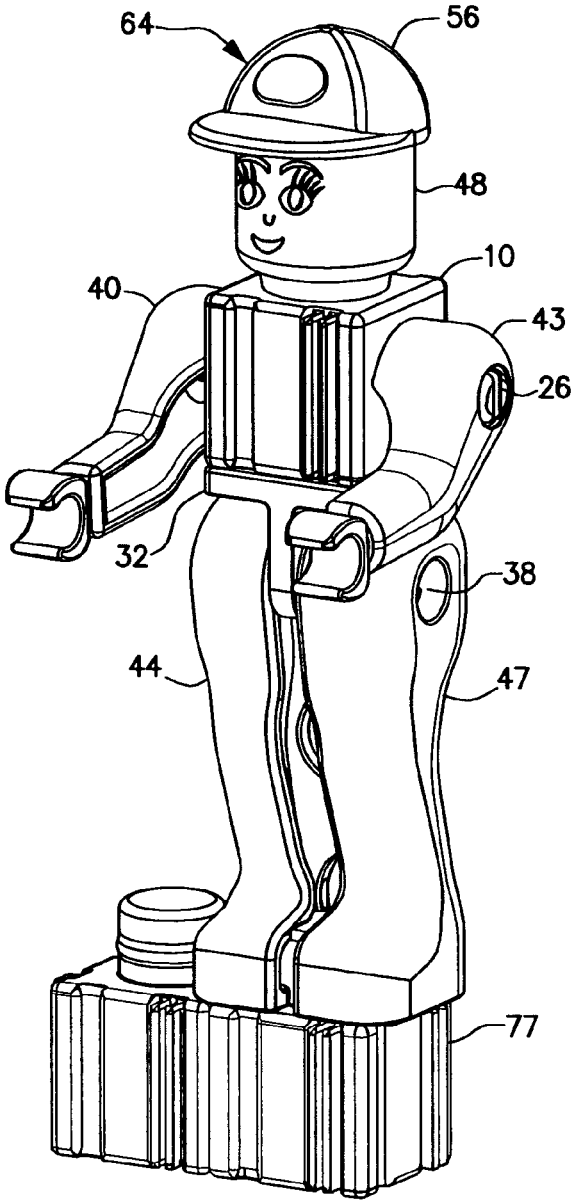
FIG. 11 is a perspective view of an embodiment of a person-like toy figure assembled by combining some of the toy-building elements of the present invention.

FIGS. 11, 11A and 11B show a person-like toy FIG. 64 that has been assembled by combining the toy-building elements 10, 32, 40, 44, 48 and 56 respectively described above with reference to FIGS. 1, 3, 4, 5, 6 and 7.

The toy-building element 10 is combined with the toy-building element 32 by engaging the projection 35 that extends from the top of the plate 34 of the toy-building element 32 with the interior contact surfaces 21 of the toy-building element 10.

The right-arm-shaped toy-building element 40 is combined with the toy-building element 10 by engaging the opening 42 in the right-arm-shaped toy-building element 40 with one axel-shaped coupler 26 of the toy-building element 10. The left-arm-shaped toy-building element 43 is combined with the toy-building element 10 by engaging the opening in the left-arm-shaped toy-building element 40 with the other axel-shaped coupler 26 of the toy-building element 10. Upon effecting such engagements, each of the arm-shaped toy-building elements 40, 43 can be variably positioned individually in relation to the toy-building element 10 by rotating the respective arm-shaped toy-building elements 40, 43 about the axel 26.

The right-leg-shaped toy-building element 44 is combined with the toy-building element 32 by engaging the opening 46 in the right-leg-shaped toy-building element 44 with one axel-shaped coupler 38 of the toy-building element 32. The left-leg-shaped toy-building element 47 is combined with the toy-building element 32 by engaging the opening in the left-leg-shaped toy-building element 47 with the other axel-shaped coupler 38 of the toy-building element 32. Upon effecting such engagements, each of the leg-shaped toy-building elements 44, 47 can be variably positioned individually in relation to the toy-building element 32 by rotating the respective leg-shaped toy-building elements 44, 47 about the axel 38.

The toy-building element 10 is combined with the head-shaped toy-building element 48 by engaging the projection 19 that extends from the top of the toy-building element 10 with the interior contact surfaces 52 of the head-shaped toy-building element 48.

The cap-shaped toy-building element 56 is combined with the head-shaped toy-building element 48 by engaging the projection 54 that extends from the top of the head-shaped toy-building element 48 with the interior contact surfaces 58 of the cap-shaped toy-building element 56.

Referring to FIG. 11A, the backs 66 of the left and right leg-shaped toy-building elements 44, 47 are respectively contoured to define a series of gaps 68, 69, 70 between the backs 66 of the respective leg-shaped toy-building elements 44, 47 when the left and right leg-shaped toy-building elements 44, 47 are engaged with the two axels 38 of the toy-building element 32 and extend at the same angle from the toy-building element 32.

Each gap 68, 69, 70 is dimensioned for effecting engagement with an interconnectable projection that extends from a further toy-building element, such as described in the aforementioned U.S. Pat. No. 6,447,360, to thereby interconnect the two leg-shaped toy-building elements 44, 47 with the further toy-building element. The upper gap 68 is located for engaging the projection from such a further toy-building element when the two leg-shaped toy-building elements 44, 47 are rotated forward in order to dispose the person-like toy FIG. 64 in a seated posture.

Referring to FIG. 11B, the right foot 72 and the left foot 73 of the two leg-shaped toy-building elements 44, 47 are contoured to define a gap 74 between the feet 72, 73 of the two leg-shaped toy-building elements 44, 47 when the two leg-shaped toy-building elements 44, 47 are engaged with the two axels 38 of the toy-building element 32 and extend at the same angle from the toy-building element 32.

The gap 74 is dimensioned for effecting engagement with an interconnectable projection 76 extending from a further toy-building element 77, as shown in FIG. 11A, to thereby interconnect the feet 72, 73 of the two leg-shaped toy-building elements 44, 47 with the further toy-building element 77. The further toy-building element 77 is configured as described in the aforementioned U.S. Pat. No. 6,447,360. In FIG. 11A, the further toy-building element 77 is interconnected with a like toy-building element 77A in a side-to-side relationship by engaging the respective grooves and tongues of the interconnected like toy-building elements 77, 77A.

In alternative embodiments, the backs and/or bottoms of the leg-shaped toy-building elements are not contoured to define such gaps between the respective leg and/or feet portions thereof.

FIG. 12 shows the person-like toy FIG. 64 of FIG. 11 in combination with the toy-building element 30 having only one axel-shaped coupler 26, as described above with reference to FIG. 2. The toy-building element 30 is interconnected with the toy-building element 10 by effecting a releasable restraining engagement between the tongues and grooves in the back sidewall of the building element 10 with the tongues and grooves in the sidewall of the building element 30 that is disposed opposite to the sidewall of the toy-building element 30 that includes the axel-shaped coupler 26.

A propeller-shaped toy-building element 79, as shown in FIGS. 13 and 13A, is combined with the toy-building element 30 by engaging an opening 80 in the propeller-shaped toy-building element 79 with the axel 26 of the toy-building element 30 to thereby enable the propeller-shaped toy-building element 79 to rotate about the axel 26 of the toy-building element 30.

Figure 14:
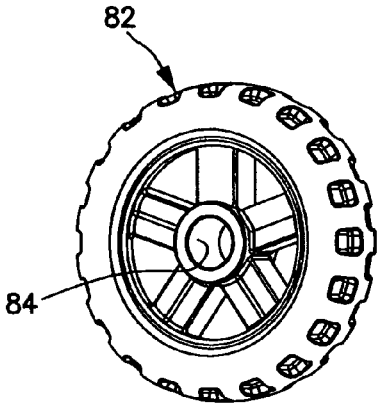
FIG. 14 is a front perspective view of an embodiment of a wheel-shaped toy-building element that is utilized in a combination of toy-building elements according to the present invention.
Figure 14A:
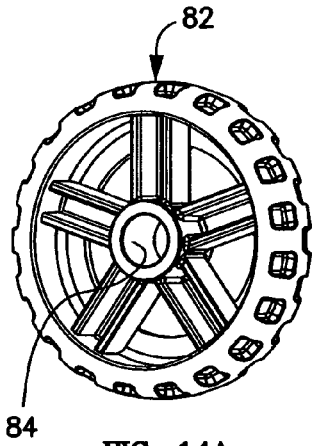
FIG. 14A is a back perspective view of the wheel-shaped toy-building element of FIG. 14.

Referring to FIGS. 14 and 14A, a wheel-shaped toy-building element 82 is provided for use in assembling vehicle-like toy figures from a combination of toy-building elements that include an axel-shaped coupler. The wheel-shaped toy-building element 82 includes an axial opening 84 that is adapted for engaging an axel 26 of the toy-building element 10 to thereby enable the wheel-shaped toy-building element 82 to rotate about the axel 26 of the toy-building element 10.

Figure 15:
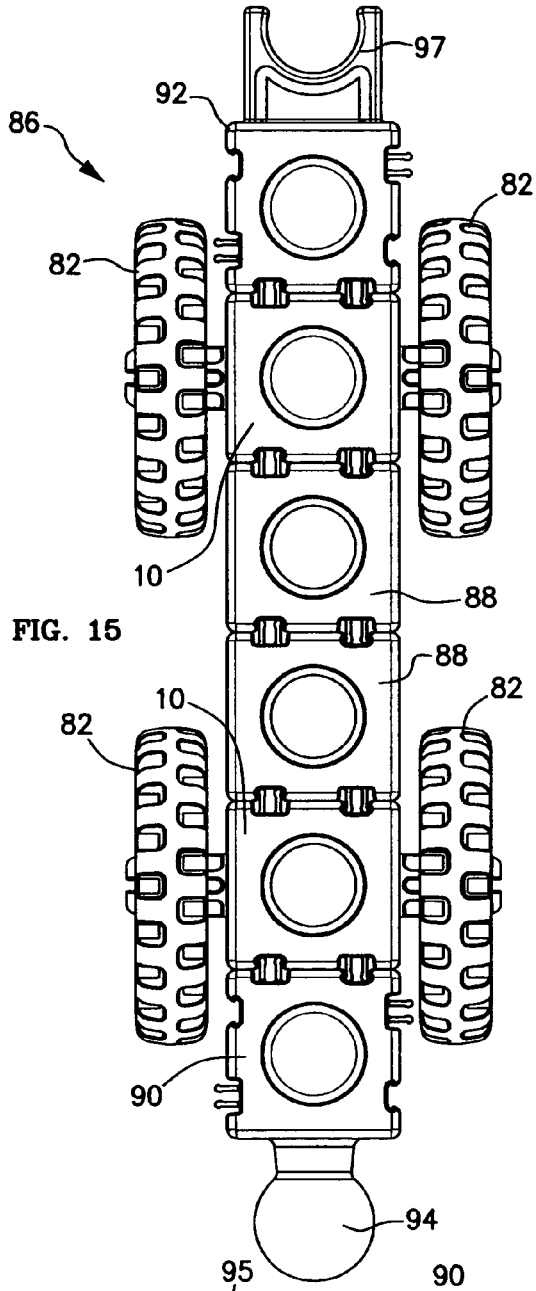
FIG. 15 is a top view of an embodiment of a vehicle-like toy figure assembled by combining some of the toy-building elements of the present invention.

Referring to FIG. 15, an exemplary vehicle-like toy FIG. 86 is assembled by combining two toy-building elements 10 with four wheel-shaped toy-building element 82 and some additional toy-building elements 88. At least one additional toy-building element 88 is connected between the two toy-building elements 10. At least two oppositely disposed sidewalls of the additional toy-building elements 88 have a groove and a tongue and are configured as described in the aforementioned U.S. Pat. No. 6,447,360 so that the two toy-building elements 10 and the at least one intermediate toy-building elements 88 can be interconnected side-to-side by engaging the respective grooves and tongues of the two toy-building elements 10 and the additional toy-building elements 88.

In an embodiment in which the vehicle-like toy FIG. 86 is adapted for being coupled to another like vehicle-like toy figure, such as when one is assembling a train of vehicle-like toy figures, toy-building elements 90, 92 respectively having couplers extending from one sidewall thereof are added to the vehicle-like toy FIG. 86. The toy-building element 90 has a ball-shaped coupler 94; and the toy-building element 92 has a socket-shaped coupler 97.

In some embodiments (not shown), vehicle-like toy figures are assembled without the toy-building 90, 92 having the couplers extending from one sidewall thereof.

In some embodiments (not shown), much more complex vehicle-like toy figures that include at least one toy-building element 10 are assembled to include various types of toy-building elements in addition to those described herein.

Figure 16:
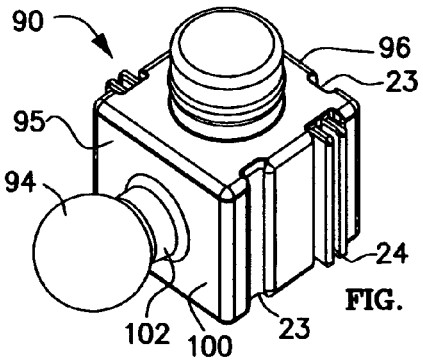
FIG. 16 is a top perspective view of still another embodiment of a toy-building element according to the present invention.
Figure 16A:
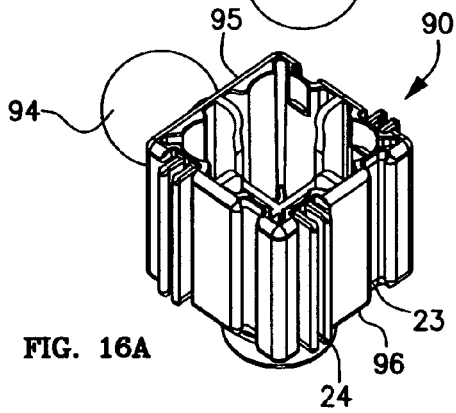
FIG. 16A is a bottom perspective view of the toy-building element of FIG. 16.

Referring to FIGS. 16 and 16A, the toy-building elements 90 has a ball-shaped coupler 94 extending from a sidewall 95 that is opposite to a sidewall 96 that has the same groove-and-tongue configuration as each of the two oppositely disposed sidewalls 12 of the toy-building element 10. The sidewall 95 includes a broad surface 100 and a neck 102 that extends the ball-shaped coupler 94 away from the broad surface 100.

Figure 17:
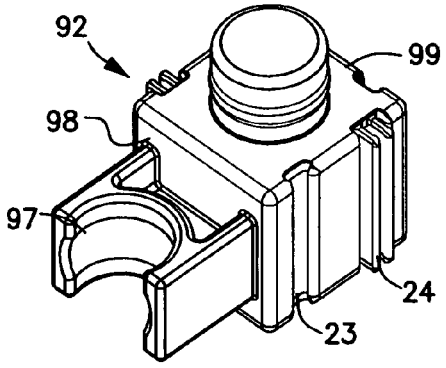
FIG. 17 is a top perspective view of yet another embodiment of a toy-building element according to the present invention.
Figure 17A:
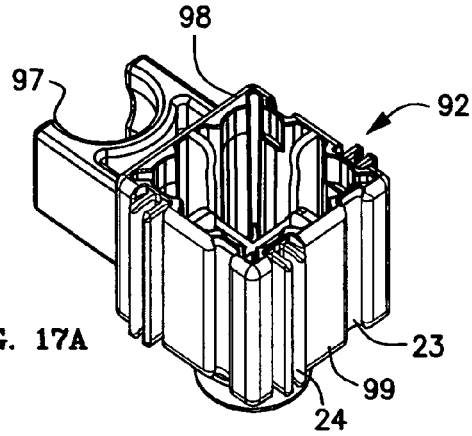
FIG. 17A is a bottom perspective view of the toy-building element of FIG. 17.

Referring to FIGS. 17 and 17A, the toy-building elements 92 has a socket-shaped coupler 97 extending from a sidewall 98 that is opposite to a sidewall 99 that has the same groove-and-tongue configuration as each of the two oppositely disposed sidewalls 12 of the toy-building element 10. The socket is dimensioned to have a primary opening of a width that approximates the diameter of ball-shaped coupler 94 of the toy-building element 90 shown in FIG. 16. The distal portion of the socket-shaped coupler 97 defines an entry opening through which the ball-shaped coupler 94 is inserted. The entry opening is less than the diameter of the ball-shaped coupler 94; and the distal portion of the socket-shaped coupler 97 is split so that the distal portion can flex to temporarily increase the entry opening to thereby to enable insertion of the ball-shaped coupler 94.

Figure 18:
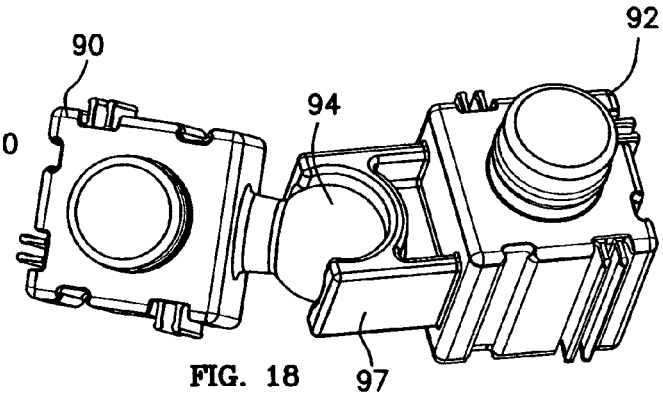
FIG. 18 is a perspective view the toy-building element of FIG. 16 in combination with the toy-building element of FIG. 17.

Referring to FIG. 18, the toy-building element 90 having the ball-shaped coupler 94 is combined with the toy-building element 92 having the socket-shaped coupler 97 by engaging the ball-shaped coupler 94 within the socket-shaped coupler 97 so that the toy-building element 92 can be variably positioned at different three-dimensional angles in relation to a horizontal axis of the toy-building element 90. The range of different three-dimensional angles is dependent upon the length of the neck 102 that extends the ball-shaped coupler 94 away from the broad surface 100.

Referring again to FIGS. 16 and 16A, the ball-shaped coupler 94 of the toy-building element 90 also may be utilized to combine the toy-building element 90 with any one of the above described toy-building elements 10, 30, 77, 88, 92 that has an open bottom and an interior having contact surfaces that are accessible through the open bottom and are adapted for effecting a releasable restraining engagement with the ball-shaped coupler of the toy-building element 90 so that the one toy-building element 10, 30, 77, 88, 92 can be variably positioned at different three-dimensional angles in relation to a horizontal axis of the toy-building element 90 when the ball-shaped coupler 94 of the toy-building element 90 is engaged with the interior contact surfaces of the one toy-building element 10, 30, 77, 88, 92.

Figure 19:
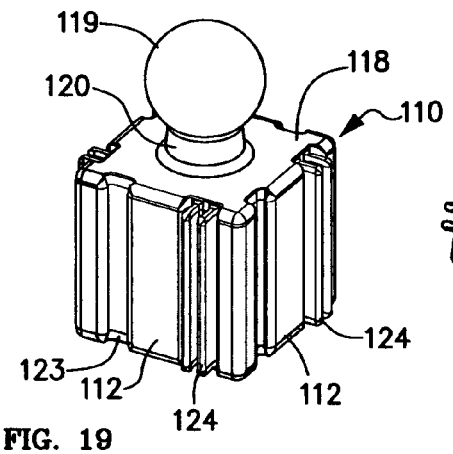
FIG. 19 is a top perspective view of a further embodiment of a toy-building element according to the present invention.
Figure 19A:
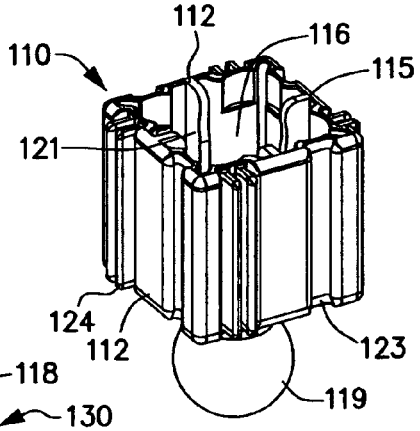
FIG. 19A is a bottom perspective view of the toy-building element of FIG. 19.

Referring to FIGS. 19, and 19A, one embodiment of another toy-building element 110 according to the present invention includes sidewalls 112, a top, an open bottom 115 and an interior 116. The top has a broad surface 118 that extends toward the sidewalls 112, 113 and a ball-shaped coupler 119 extending above the broad surface 118. The top further includes a neck 120 that extends the ball-shaped coupler 119 away from the top broad surface 118.

The interior 116 has contact surfaces 121 that are accessible through the open bottom 115 and are adapted for effecting a releasable restraining engagement with an interconnectable projection on another toy-building element. In the preferred embodiments, the interior contact surfaces are configured as described in the aforementioned U.S. Pat. No. 6,447,360. Other configurations may be used in other embodiments.

Each of sidewalls 112 includes at least one groove 123 and at least one tongue 124. Each groove 123 is adapted for effecting a releasable restraining engagement with a tongue in a sidewall of another toy-building element; and each tongue 124 is adapted for effecting a releasable restraining engagement with a groove in a sidewall of another toy-building element. In the preferred embodiments, the grooves 123 and the tongues 124 are configured as described in the aforementioned U.S. Pat. Nos. 6,250,986 and 6,616,499. Other configurations may be used in other embodiments. Also, in other embodiments, some of the sidewalls do not necessarily include tongues and grooves, provided that at least one sidewall includes a groove and at least one sidewall includes a tongue that is interconnectable with the groove. In other embodiments, one or more of the sidewalls may include a coupler or an interconnectable coupler, such as described hereinabove.

The ball-shaped coupler 119 of the toy-building element 110 also may be utilized to combine the toy-building element 110 with any one of the above described toy-building elements 10, 30, 77, 88, 90, 92 that has an open bottom; and an interior having contact surfaces that are accessible through the open bottom and are adapted for effecting a releasable restraining engagement with the ball-shaped coupler 119 of the toy-building element 110 so that the one toy-building element 10, 30, 77, 88, 90, 92 can be variably positioned at different three-dimensional angles in relation to a vertical axis of the toy-building element 110 when the ball-shaped coupler 119 of the toy-building element 110 is engaged with the interior contact surfaces of the one toy-building element 10, 30, 77, 88, 92. The range of different three-dimensional angles is dependent upon the length of the neck 120 that extends the ball-shaped coupler 119 away from the top broad surface 118.

Figure 19B:
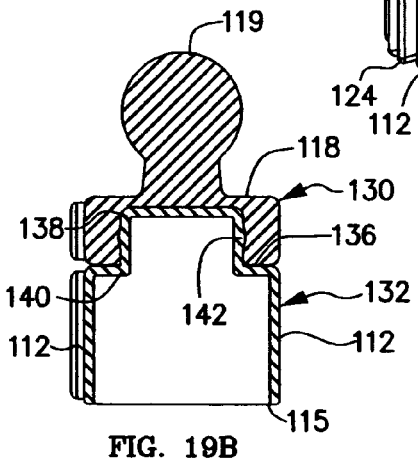
FIG. 19B is a sectional side view of an alternative embodiment of the toy-building element of FIG. 19 taken through a central vertical plane that is parallel with two oppositely disposed sidewalls.

Referring to FIG. 19B, one embodiment of the toy-building element 110 that has a ball-shaped coupler 119 extending above the top broad surface 118 is assembled by combining two components 130, 132 that possibly could be injection molded separately more efficiently than a unitary embodiment of the toy-building element 110 could be injection molded. The first component 130 includes the top that has the broad surface 118 and the ball-shaped coupler 119. The second component 132 includes the sidewalls 112 the open bottom 115, the interior 116 having the contact surfaces 121.

The second component 132 also includes a top having a broad surface 136 that extends toward the sidewalls 112 and a projection 138 that extends above the broad surface 136. The first component 130 also includes an open bottom 140 and interior contact surfaces 142 that are accessible through the open bottom 140 and are adapted for effecting a releasable restraining engagement with the projection 138 on the second component 132.

Figure 20:
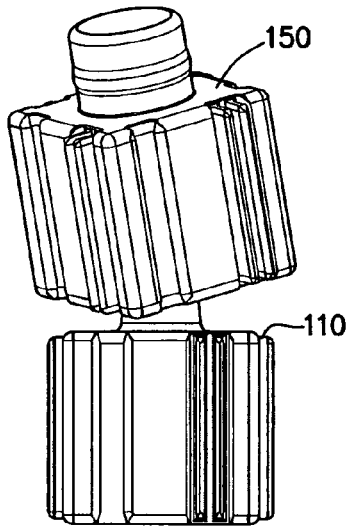
FIG. 20 is a perspective view the toy-building element of FIG. 19 in combination with another toy-building element.

Referring to FIG. 20, the toy-building element 110 having the ball-shaped coupler 119 is combined with a toy-building element 150 that has an open bottom and an interior having contact surfaces that are accessible through the open bottom and are adapted for effecting a releasable restraining engagement with the ball-shaped coupler 119 on the toy-building element 10 so that the toy-building element 150 can be variably positioned at different three-dimensional angles in relation to a vertical axis of the toy-building element 10 when the ball-shaped coupler 119 of the toy-building element 110 is engaged with the interior contact surfaces of the toy-building element 150. The interior contact surfaces of the toy-building element 150 are configured as described in the aforementioned U.S. Pat. No. 6,447,360.

In some embodiments (not shown) ball-shaped couplers are substituted for the axel-shaped couplers 26 in the toy-building element 10 of FIG. 1 and/or the toy-building element 30 of FIG. 2 and/or for the axel-shaped couplers 38 in the toy-building element 32 of FIG. 3. Toy-building elements of the type shown in FIGS. 1 and 3 but having the substituted ball-shaped couplers may be combined with arm-shaped toy-building elements and leg-shaped toy-building elements that include socket-shaped interconnectable couplers to assemble person-like toy figures in which the arm-shaped toy-building elements and leg-shaped toy-building elements have a greater range of motion than toy figures that are assembled with toy-building elements 10, 32 having axel-shaped couplers 26, 38, such as described above with reference to FIG. 11.

In some embodiments (not shown) ball-shaped couplers are substituted for the projection 19 from the top 14 of the toy-building element 10 of FIG. 1 and/or the toy-building element 30 of FIG. 2 and/or for the projection 35 from top of the plate 34 of the toy-building element 32 of FIG. 3. A toy-building elements of the type shown in FIG. 1 but having the substituted ball-shaped projection from the top may be combined with a head-shaped toy-building elements to assemble person-like toy figures in which the head-shaped toy-building element has a greater range of motion than in toy figures that are assembled with the toy-building element 10 having a post-shaped projection 19 from the top 14, such as described above with reference to FIG. 11.

In some embodiments, one or more couplers may be included in a sidewall that includes at least one groove and/or at least one tongue.

In still other embodiments the various features of the different embodiments described herein are combined with one another to the extent that they are not incompatible with each other.

Preferably, the various toy-building elements described herein are manufactured by injection molding, although other manufacturing processes can be utilized.

Some of the toy-building elements described above that are not claimed herein are the subjects of other patents or patent applications.

The benefits specifically stated herein do not necessarily apply to every conceivable embodiment of the present invention. Further, such stated benefits of the present invention are only examples and should not be construed as the only benefits of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

The invention claimed is:

1. A combination of toy-building elements for a toy that includes a plurality of toy-building elements, the combination including a first toy-building element comprising:

sidewalls;

a top having a broad surface that extends toward the sidewalls and at least one projection extending above the broad surface;

an open bottom; and an interior having contact surfaces that arc accessible through the open bottom and are for effecting a releasable restraining engagement with an interconnectable projection on a second toy-building element;

wherein at least one of the sidewalls includes a coupler for effecting a variably positional engagement with an interconnectable coupler in another toy-building element that can be variably positioned in relation to the first toy-building element when the coupler of the first toy-building element is engaged with said interconnectable coupler of said another toy-building element; and a second toy building element, comprising:

a plate, a projection that extends from the top of the plate for effecting said engagement with the interior contact surfaces of the first toy-building element;

a member that extends from the bottom of the plate; and a pair of couplers that extend from opposite sides of the member for respectively effecting a variably positional engagement with an interconnectable coupler in a further toy-building element that can be variably positioned in relation to the second toy-building element when a said coupler of the second toy-building element is engaged with said interconnectable coupler of said further toy-building element;

wherein the lateral breadth of the member in at least the dimension in which the couplers extend is less than the lateral extension of the plate.

2. A combination of toy-building elements according to claim 1, wherein each of two oppositely disposed sidewalls of said sidewalls includes a said coupler.

3. The combination of toy-building elements according to claim 2 in combination with two said another toy-building elements, two said further toy-building elements and a head-shaped toy-building element that includes an open bottom and an interior having contact surfaces that are accessible through the open bottom and are for effecting a releasable restraining engagement with the projection on the first-recited toy-building element;

wherein the two yet other toy-building elements are shaped as left and right arms or legs and the two further toy-building elements are shaped as left and right legs.

4. The combination of said toy-building elements according to claim 3 in combination with a headgear-shaped toy-building element;

wherein the head-shaped toy-building element includes a projection that extends from the top of the head; and wherein headgear-shaped toy-building element includes an open bottom and an interior having contact surfaces that are accessible through the open bottom and are for effecting a releasable restraining engagement with the projection on the head-shaped toy-building element.

5. The combination of said toy-building elements according to claim 3, wherein at least one of the couplers is shaped as an axel and at least one of said interconnectable couplers is defined as an opening that enables the said toy-building element that includes the opening to rotate about the axel when the axel is engaged within the opening.

6. The combination of said toy-building elements according to claim 3 in combination with a third toy-building element and a propeller-shaped toy-building element, wherein at least one of the sidewalls of the first-toy-building element includes at least one groove for effecting a releasable restraining engagement with a tongue in a sidewall of yet another toy-building element;

wherein at least one of the sidewalls of the first toy-building element includes at least one said tongue that is for effecting a releasable restraining engagement within a said groove in a sidewall of still another toy-building element;

wherein one side of the third toy-building element includes at least one said groove and/or at least one said tongue for effecting a releasable restraining engagement with said at least one tongue and/or said at least one said groove in one sidewall of the first toy-building element;

wherein the side of the third toy-building element that is opposite said one side is an axel; and wherein the propeller-shaped toy-building element includes a bore for enabling the propeller-shaped toy-building element to rotate about the axel.

7. A combination of toy-building elements according to claim 1, wherein the plate of the second toy-building element is coextensive with the bottom of the first-recited toy-building element.

8. A combination of toy building elements according to claim 1, wherein at least one of the sidewalls of the first toy-building element includes at least one groove for effecting a releasable restraining engagement with a tongue in a sidewall of yet another toy-building element; and wherein at least one of the sidewalls of the first toy-building element includes at least one said tongue that is for effecting a releasable restraining engagement within a said groove in a sidewall of still another toy-building element.

9. The combination of toy-building elements according to claim 8 in combination with a third toy-building element, wherein one side of the third toy-building element includes at least one said groove and/or at least one said tongue for effecting a releasable restraining engagement with said at least one tongue and/or said at least one said groove in one sidewall of the first toy-building element; and wherein the side of the third toy-building element that is opposite said one side is an axel.

10. A combination of toy-building elements according to claim 1, wherein the coupler of the first building element includes a distal portion of a thickness that is larger than an entry opening of said interconnectable coupler of said further toy-building element; and wherein the distal portion of the coupler of the first building element is split longitudinally so that the thickness of the distal portion can be compressed enough to enable insertion of the distal portion through the entry opening of said interconnectable coupler of said further toy-building element.

11. A combination of toy-building elements according to claim 1, wherein the coupler of the first building element is shaped as an axel and said interconnectable coupler is defined as an opening that enables a said another toy-building element that includes the opening to rotate about the axel when the axel is engaged within the opening.

12. A combination of toy-building elements according to claim 1, wherein one of the coupler of the first building element and the interconnectable coupler is shaped as a ball and the other of the coupler of the first building element and the interconnectable coupler is shaped as a socket for enabling the said toy-building element that includes the socket to be variably positioned about the ball when the coupler of the first building element is engaged with the interconnectable coupler.

13. A combination of toy-building elements according to claim 1, wherein the coupler of the first building element is shaped as a ball.

14. A combination of toy-building elements according to claim 13 in combination with a said another toy-building element that comprises sidewalls; a top; an open bottom; and an interior having contact surfaces that are accessible through the open bottom and are for effecting a releasable restraining engagement with the ball-shaped coupler of the first toy-building element so that the yet another toy-building element can be variably positioned at different three-dimensional angles in relation to a horizontal axis of the first toy-building element when the ball-shaped coupler of the first toy-building element is engaged with the interior contact surfaces of the yet another toy-building element.

15. A combination of toy-building elements for assembling a person-like toy figure, comprising: a first toy-building element, a second toy-building element, a left-arm-shaped building element, a right-arm-shaped building element, a left-leg-shaped building element, a right-leg-shaped building element and a head-shaped toy-building element, wherein the first toy-building element includes sidewalls; a top having a broad surface that extends toward the sidewalls and a projection extending above the broad surface; an open bottom; and an interior having contact surfaces that are accessible through the open bottom and are for effecting a releasable restraining engagement with an interconnectable projection on the second toy-building element;

wherein each of two oppositely disposed sidewalls of the first toy-building element includes a coupler for effecting a variably positional engagement with an interconnectable coupler in either of the arm-shaped building elements;

wherein the second toy-building element includes a plate; a projection that extends from the top of the plate for effecting said engagement with the interior contact surfaces of the first-recited toy-building element; a member of uniform lateral dimensions that extends from the bottom of the plate and a pair of couplers extending from opposite sides of the member for effecting a variably positional engagement with an interconnectable coupler in either of the leg-shaped toy-building elements;

wherein the lateral breadth of the member in at least the dimension in which the couplers extend is less than the lateral extension of the plate;

wherein the head-shaped toy-building element includes an open bottom and an interior having contact surfaces that are accessible through the open bottom and are for effecting a releasable restraining engagement with the projection on the first toy-building element;

wherein each of the arm-shaped toy-building elements includes a said interconnectable coupler for effecting said variably positional engagement with a said coupler of the first toy-building element; and wherein each of the leg-shaped toy-building elements includes a said interconnectable coupler for effecting said variably positional engagement with a said coupler of the second toy-building element.

16. A combination of toy-building elements according to claim 15, wherein the plate of the second toy-building element is coextensive with the bottom of the first-recited toy-building element.

17. A combination of toy-building elements according to claim 15, wherein the backs of the leg-shaped toy-building elements are contoured to define at least one gap between the backs of the left-and-right-leg-shaped toy-building elements when the left-and-right-leg-shaped toy-building elements are engaged with the two axels of the second toy-building element and extend at the same angle from the second toy-building element; and wherein said at least one gap is dimensioned for effecting engagement with an interconnectable projection extending from a further toy-building element and thereby interconnect the left-and-right-leg-shaped toy-building elements with said further toy-building element.

18. A combination of toy-building elements according to claim 15, wherein the feet of the leg-shaped toy-building elements are contoured to define a gap between the feet of the left-and-right-leg-shaped toy-building elements when the interconnectable couplers of the left-and-right-leg-shaped toy-building elements are engaged with the couplers of the second toy-building element and extend at the same angle from the second toy-building element; and wherein said gap is dimensioned for effecting engagement with an interconnectable projection extending from a further toy-building element and thereby interconnect the feet of the left-and-right-leg-shaped toy-building elements with said further toy-building element.

* * * * *

UNITED STATES PATENT AND TRADEMARK OFFICE

CERTIFICATE OF CORRECTION

PATENT NO. : 7,553,209 B1
APPLICATION NO. : 11/131830
DATED : June 30, 2009
INVENTOR(S) : Soren Christian Sorensen It is certified that error appears in the above-identified patent and that said Letters Patent is hereby corrected as shown below:

Column 1, line 30, "a body; and" should be omitted

Column 1, line 30, "late" should be "plate"

Column 10, line 32, "arc" should be "are"

Column 12, line 38, "yet" should be omitted

Column 12, line 43, "yet" should be omitted

Signed and Sealed this

Thirteenth Day of October, 2009

David J. Kappos

David J. Kappos
*Director of the United States Patent and Trademark Office*